US007284753B2

(12) United States Patent
Kotani

(10) Patent No.: US 7,284,753 B2
(45) Date of Patent: Oct. 23, 2007

(54) PRINTING DEVICE WITH MANUAL PAPER FEEDING FUNCTION

(75) Inventor: Masaki Kotani, Uji (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 113 days.

(21) Appl. No.: 10/999,526

(22) Filed: Nov. 29, 2004

(65) Prior Publication Data

US 2005/0189694 A1 Sep. 1, 2005

(30) Foreign Application Priority Data

Jan. 6, 2004 (JP) ..... 2004-000736

(51) Int. Cl.
*B65H 3/44* (2006.01)

(52) U.S. Cl. ..... 271/9.06; 271/9.09; 399/81

(58) Field of Classification Search ..... 271/9.01, 271/9.05, 9.06, 9.09; 399/81
See application file for complete search history.

(56) References Cited

U.S. PATENT DOCUMENTS

| | | | | |
|---|---|---|---|---|
| 5,125,636 | A * | 6/1992 | Higashio et al. | 271/9.09 |
| 5,129,639 | A * | 7/1992 | DeHority | 270/1.01 |
| 5,321,486 | A * | 6/1994 | Nanbu et al. | 399/14 |
| 5,459,580 | A * | 10/1995 | Suzuki | 358/296 |
| 5,689,759 | A * | 11/1997 | Isemura et al. | 399/45 |
| 5,717,977 | A * | 2/1998 | Suzuki et al. | 399/45 |
| 5,768,677 | A * | 6/1998 | Natsume | 399/376 |
| 5,828,818 | A * | 10/1998 | Anzai | 358/1.18 |
| 5,961,226 | A * | 10/1999 | Nishida | 400/70 |
| 6,024,505 | A * | 2/2000 | Shinohara | 400/605 |
| 6,169,863 | B1 * | 1/2001 | Osari et al. | 399/82 |
| 6,266,512 | B1 * | 7/2001 | de Koning et al. | 399/370 |
| 6,267,522 | B1 * | 7/2001 | Slippy et al. | 400/708.1 |
| 6,621,992 | B2 * | 9/2003 | Kishi et al. | 399/81 |
| 6,674,981 | B2 * | 1/2004 | Sugimoto | 399/81 |
| 6,701,099 | B2 * | 3/2004 | Yokobori et al. | 399/45 |
| 6,810,219 | B2 * | 10/2004 | Yokobori et al. | 399/45 |
| 6,817,794 | B2 * | 11/2004 | Kakutani | 400/582 |
| 6,823,147 | B2 * | 11/2004 | Jackelen et al. | 399/16 |
| 6,865,354 | B2 * | 3/2005 | Jackelen et al. | 399/81 |
| 6,873,426 | B1 * | 3/2005 | Farrell | 358/1.15 |
| 6,873,812 | B2 * | 3/2005 | Kobayashi | 399/193 |
| 6,876,824 | B2 * | 4/2005 | Maeda | 399/82 |
| 2003/0215252 | A1 * | 11/2003 | Yokobori et al. | 399/45 |
| 2003/0230842 | A1 * | 12/2003 | Shiho et al. | 271/9.01 |
| 2004/0141762 | A1 * | 7/2004 | Okamoto et al. | 399/23 |

FOREIGN PATENT DOCUMENTS

| | | |
|---|---|---|
| EP | 1 108 554 | 6/2001 |
| JP | 05-162873 | 6/1993 |
| JP | 06-148990 | 5/1994 |
| JP | 06-337560 | 12/1994 |
| JP | 10-109762 | 4/1998 |
| JP | 11-292349 | 10/1999 |
| JP | 2001-166641 | 6/2001 |
| JP | 2002-091245 | 3/2002 |

* cited by examiner

*Primary Examiner*—Patrick Mackey
(74) *Attorney, Agent, or Firm*—Hogan & Harston LLP

(57) ABSTRACT

A printing device with a manual paper feeding function includes a manual paper feeding unit, a first paper size input unit that inputs a paper size by an operation and a second paper size input unit that detects a paper size of fed paper and inputs the detected paper size.

17 Claims, 5 Drawing Sheets

PRINTING DEVICE WITH MANUAL PAPER FEEDING FUNCTION

BACKGROUND OF THE INVENTION

1. Field of the Invention

The present invention relates to a printing device such as a copying machine, a Multi Function Peripheral (MFP) having multiple functions such as a copy function and a facsimile function and a printer device. In particular, the present invention relates to a printing device with a manual paper feeding function.

2. Description of Related Art

A conventional printing device such as a copying machine includes a paper cassette and also a manual paper feeding unit. There are cases in which the printing device carries out a copying process by a manual paper feeding operation. In such a type of printing device with a manual paper feeding operation, to carry out a copying (printing) process onto paper fed from the manual paper feeding unit, in case the manual paper feeding operation is a multiple manual feeding operation, when a paper size recognized by the printing device is different from a paper size of the paper actually set in the manual paper feeding unit, a paper size error is displayed to urge the user to set a correct paper size. Meanwhile, in case the manual paper feeding operation is a single manual feeding, when the paper size recognized by the printing device is different from the paper size of the paper actually set in the manual paper feeding unit, the paper size error is ignored and the copying process is carried out.

A conventional printing device includes a first printing mode and a second printing mode. Under the first printing mode, a paper size of paper set on a manual paper feeding unit is designated from outside and a printing sequence is carried out in accordance with the designated paper size. Under the second printing mode, without designating the paper size from outside, the printer device measures the paper size and a printing sequence is carried out in accordance with the measured paper size. After the paper size is designated from outside, when the paper set on the manual paper feeding unit runs out, the printing device switches once to a size measuring mode. After the paper size is measured, the printing device switches to an appropriate paper size mode.

When carrying out the copying process onto the paper fed from the manual paper feeding unit, the paper size is detected. When the detected paper size corresponds with the paper size previously recognized by the printing device, papers are fed sequentially from the manual paper feeding unit to a printer unit at an interval corresponding to the detected paper size. That is, a printing sequence is carried out in accordance with the detected paper size. However, there are cases in which the paper size cannot be detected. For example, when the paper size is a nonstandard size, the paper size cannot be detected. In case a printing sequence of A4 size papers is in progress and the papers are fed sequentially at an interval corresponding to the A4 size papers, when nonstandard sized paper larger than the A4 size paper is fed during the printing sequence, a paper size error is displayed to urge the user to set the correct paper again. Therefore, even when the printing process can be continued with the nonstandard sized paper, the printing process is interrupted. As a result, there is a drawback of a decrease in printing efficiency which causes the user to feel troublesome. In case the paper size is unknown, the conventional printing device cannot deal with the drawback.

SUMMARY OF THE INVENTION

The present invention has been made in consideration of the above-described circumstances. An advantage of the present invention is to provide a printing device with a manual paper feeding function which can appropriately fix a paper size of fed paper without lowering printing efficiency and without complicating an operation even when the paper size is a nonstandard size.

According to an aspect of the present invention, a printing device with a manual paper feeding function includes a first paper size input unit which inputs a paper size by an operation, and a second paper size input unit which detects a paper size of fed paper and inputs the detected paper size. In the printing device of the present invention, the paper size can be input by one of the first paper size input unit and the second paper size input unit. Therefore, various paper sizes can be input reliably in the printing device of the present invention.

According to an aspect of the present invention, when the paper size is input by the first paper size input unit, the input paper size is fixed. Under a state in which the paper size is not input by the first paper size input unit, when the paper size is input by the second paper size input unit, the paper size detected and input by the second paper size input unit is fixed as the paper size.

According to an aspect of the present invention, a printing device with a manual paper feeding function includes a determining unit, a paper size fixing unit and an inquiring unit. Under a state in which the paper size input by the first paper size input unit is registered, the determining unit determines whether the paper size input by the second paper size input unit corresponds with the registered paper size. When the determining unit determines that the paper sizes correspond with one another, the paper size fixing unit fixes the paper size. When the determining unit determines that the paper sizes do not correspond with one another, the inquiring unit inquires whether to change the detected paper size to the fixed paper size.

According to an aspect of the present invention, when the printing device with the manual paper feeding function receives a response of "YES" for the inquiry of whether to change the detected paper size to the fixed paper size, the paper size input by the second paper size input unit is fixed as the paper size. When the printing device receives a response of "NO", the registered paper size is maintained as it is.

According to the present invention, the paper size can be input by selecting one of the first paper size input unit and the second paper size input unit. Therefore, even when the paper size of the fed paper is a nonstandard size, the paper size can be fixed appropriately. As a result, the printing process by the manual paper feeding can be continued smoothly. In case of inputting the paper size by the operation, a distinction of the paper size can be input relatively minutely. In case of inputting the detected paper size, the paper size can be input automatically. Either one of the input units can be selected for inputting the paper size so that advantages of each of the input units are utilized.

DETAILED DESCRIPTION OF THE INVENTION

Embodiments of the present invention will be described.

Figure 1:
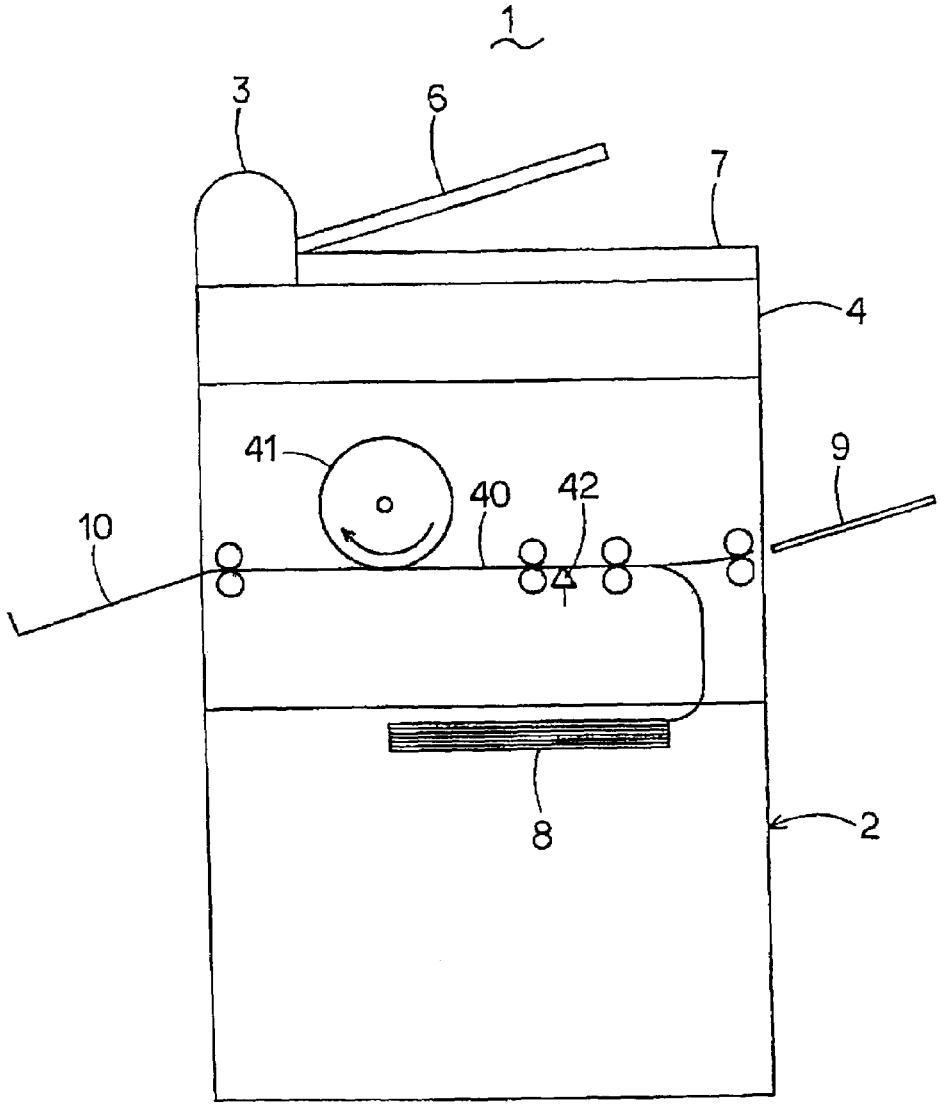
FIG. 1 is a schematic drawing of a facsimile machine (a MFP) as a printing device according to an embodiment of the present invention.

FIG. 1 is a schematic drawing of a facsimile machine as a printing device according to an embodiment of the present invention. The facsimile machine 1 is formed as a MFP having a facsimile function and a copy function. An Automatic Document Feeder (ADF) 3 is provided at one end on an upper part of a frame 2. A document feeding tray 6 and a document discharge tray 7 are provided on the upper part of the frame 2. An original document to be scanned is set on the document feeding tray 6. A scanned original document is discharged onto the document discharge tray 7. The ADF 3 and the trays 6 and 7 are connected integrally on the frame 2 by a hinge at a rear side of the frame 2 in a manner that a front side can be opened and closed. A Flat Bed Scanner (FBS) 4 is provided below the ADF 3 and the trays 6 and 7. The functions of these parts are not different from those of a conventional machine, and a description will be omitted.

A paper cassette 8 is provided in the frame 2 of the facsimile machine 1. The paper cassette 8 stores printing papers. A manual paper feeding unit 9 is provided at a side of the frame 2. A paper discharge tray 10 is provided at an opposite side of the frame 2. Paper 40 fed from the paper cassette 8 or the manual paper feeding unit 9 is printed by a photoconductive drum 41. The paper 40 on which an image has been printed is discharged onto the paper discharge tray 10. A size sensor 42 for detecting a length of the paper is provided along a paper transportation path.

Figure 2:
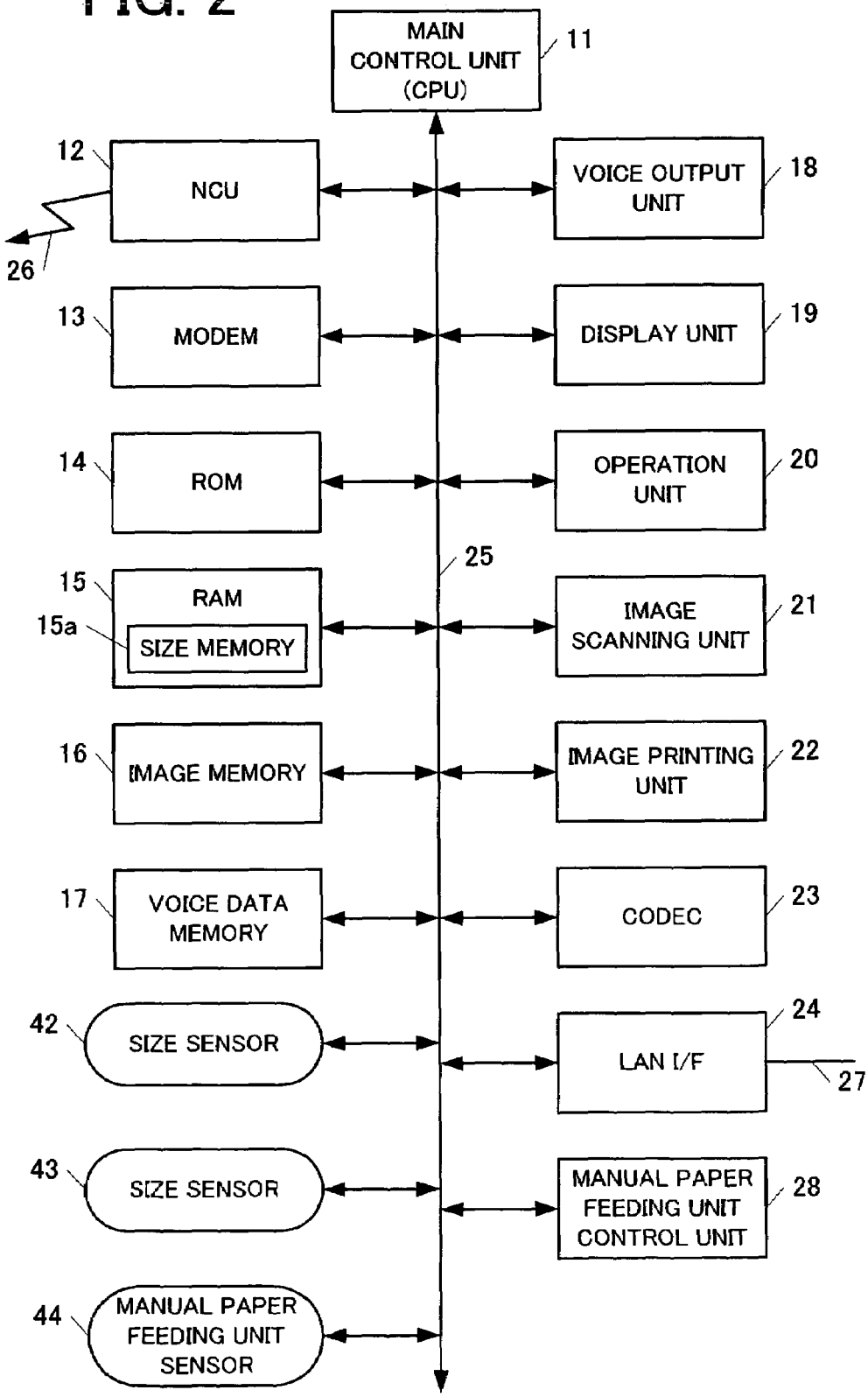
FIG. 2 is a block diagram showing an example of a structure of the facsimile machine according to the embodiment of the present invention.

FIG. 2 is a block diagram showing an example of a structure of the facsimile machine 1. The facsimile machine 1 includes a main control unit (a Central Processing Unit (CPU)) 11, a Network Control Unit (NCU) 12, a modem 13, a Read Only Memory (ROM) 14, a Random Access Memory (RAM) 15, an image memory 16, a voice data memory 17, a voice output unit 18, a display unit 19, an operation unit 20, an image scanning unit 21, an image printing unit 22, a codec 23, a Local Area Network Interface (LAN I/F) 24, a bus 25, a manual paper feeding unit control unit 28, size sensors 42 and 43 and a manual paper feeding unit sensor 44.

The main control unit 11 controls each of the units of the facsimile machine 1 in accordance with a program stored in the ROM 14. The main control unit 11 includes a function for determining whether or not a size has been input from the operation unit 20. The main control unit 11 also includes a function for determining whether or not a paper size has been detected by the size sensors 42 and 43. The main control unit 11 also includes a function for fixing a paper size with the size determined to be input from the operation unit 20. The main control unit 11 also includes a function for fixing the paper size with the paper size detected by the size sensors 42 and 43. In case of the manual paper feeding, when carrying out the printing process for two sheets or more, the main control unit 11 determines whether or not the paper size is unknown. When the paper size is unknown, the main control unit 11 controls to end the printing process. In case of a presence of a next page, the main control unit 11 controls to feed the next page. In case of an absence of the next page, the main control unit 11 controls to end the process. Until a completion of the printing process, the main control unit 11 determines whether or not the paper size is A3 size or smaller. When a measured value of the paper size exceeds the length of the A3 size paper before the completion of the printing process, the main control unit 11 controls to make a determination that paper is jammed.

The NCU 12 controls a connection established with a telephone line 26. The NCU 12 includes a function for transmitting a telephone number (a corresponding dial signal) of a destination and a function for detecting an incoming call. The NCU 12 receives a dial tone signal, a calling tone (CNG) signal or the like from the telephone line 26. The modem 13 modulates transmission data and demodulates received data in accordance with V.17, V.27ter, V.29 or the like based on a facsimile transmission control protocol according to the International Telecommunication Union-Telecommunications (ITU-T) Recommendation T.30.

The ROM 14 stores a program for controlling the entire facsimile machine 1. The RAM 15 temporarily stores various pieces of information relating to the facsimile machine 1. The RAM 15 includes a size memory 15*a* for storing a value corresponding to the length of the A3 size paper. The image memory 16 temporarily stores received image data or image data scanned by the image scanning unit 21.

The voice data memory 17 stores voice data of various voice guidances. For example, the voice data is "Paper is jammed. Please remove the jammed paper." or "Paper is jammed." output when the paper is jammed. The voice output unit 18 outputs the voice guidance stored in the voice data memory 17 from a speaker or the like. The display unit 19 displays various pieces of information such as an operational status of the facsimile machine 1 and a transfer time or the like. The operation unit 20 includes a key for setting and inputting a paper size, and also a ten-key numeric pad, a one-touch key, a start key and other various keys. From the operation unit 20, the paper size such as A3 size, A4 size, B4 size and B5 size can be set. Furthermore, another paper size can be set by the ten-key numeric pad or the like.

The image scanning unit 21 scans an image of an original document and outputs image data. The image printing unit 22 is an electrophotographic printer. The image printing unit 22 prints onto printing paper, the received image data or the image data of the original document scanned by the image scanning unit 21 in a copying operation. The codec 23 encodes the transmission image data and decodes the received image data. The LAN I/F 24 transmits and receives various data via a LAN 27 with a remote device.

The manual paper feeding unit control unit 28 controls the operation of the manual paper feeding unit 9 provided in the frame 2. Specifically, when the manual paper feeding unit sensor 44 is turned on, the manual paper feeding unit control unit 28 detects that the manual paper feeding unit 9 has been opened from the frame 2. The manual paper feeding unit control unit 28 controls a paper feeding operation or the like in accordance with a command from the main control unit 11.

Figure 3:
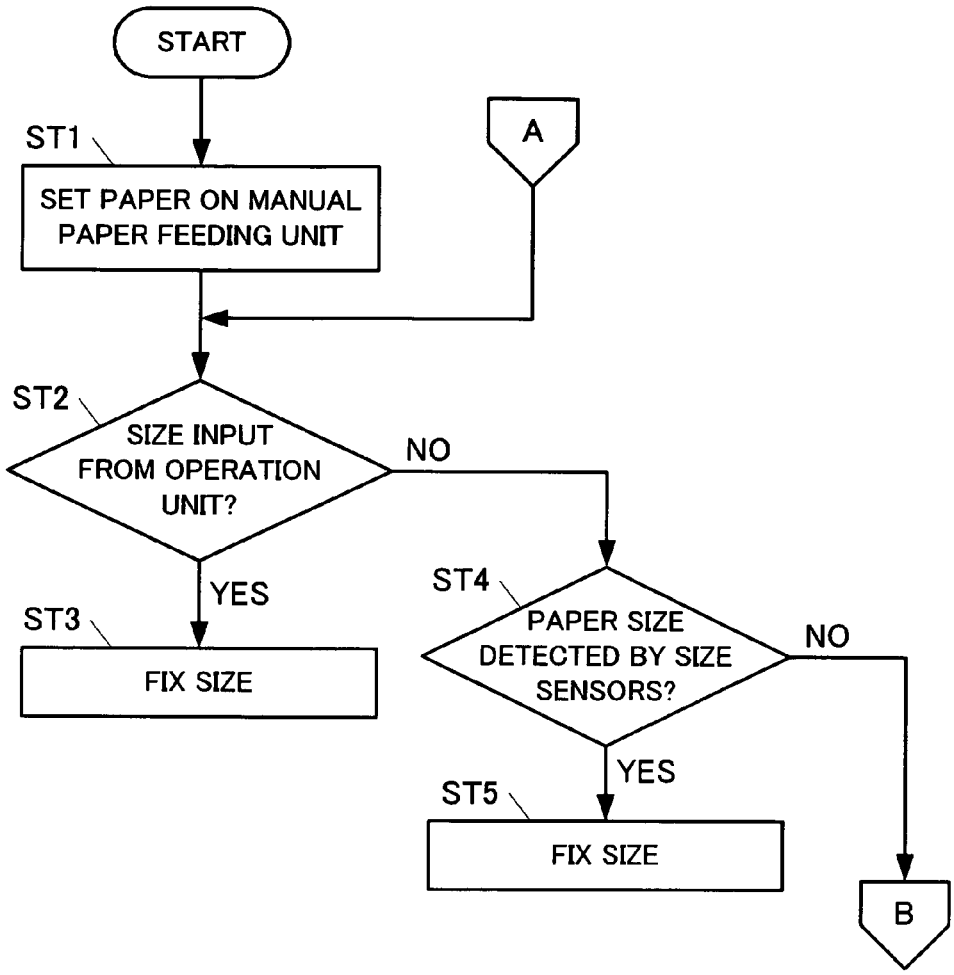
FIG. 3 is a flowchart of a processing operation carried out when feeding paper manually in the facsimile machine according to the embodiment of the present invention.
Figure 5:
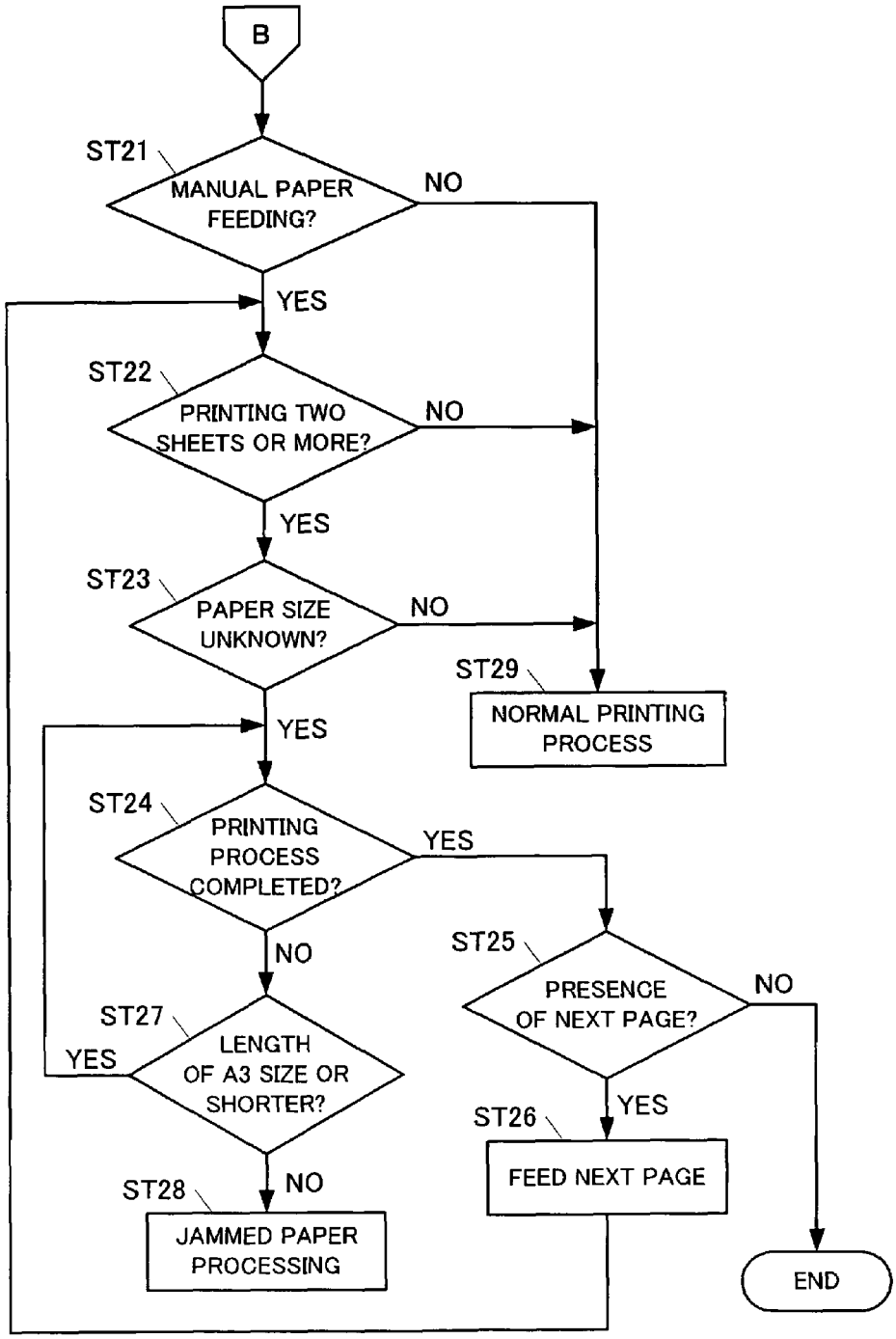
FIG. 5 is a flowchart of a processing operation carried out when feeding paper manually in the facsimile machine according to the embodiment of the present invention, which is added to the processing operation of FIG. 3.

Next, referring to the flowcharts of FIGS. 3 and 5, the processing operation carried out when feeding paper manually in the facsimile machine 1 of the present embodiment will be described. When this job starts, at step ST1, paper is set on the manual paper feeding unit 9. Next, the process proceeds onto step ST2. At step ST2, a determination is made as to whether or not the paper size has been input from the operation unit 20. When the paper size has been input by operating the keys of the operation unit 20, the process proceeds onto step ST3. At step ST3, the paper size input by operating the keys of the operation unit 20 is fixed. Meanwhile, when the paper size has not been input, the process proceeds onto step ST4.

At step ST4, a determination is made as to whether or not the paper size of the fed paper has been detected by the size sensors 42 and 43. The size sensor 42 detects a length of the paper. The size sensor 43 detects a width of the paper. In accordance with outputs from the size sensors 42 and 43, a detection is carried out on the paper size, i.e. the paper is of which standard size. In case the detected paper size is a standard size, the process proceeds onto step ST5. At step ST5, the detected paper size is fixed as the paper size. Meanwhile, when the detected paper size is a nonstandard size, without fixing the paper size, the process proceeds onto step ST21 of the flowchart of FIG. 5.

At step ST21, a determination is made as to whether or not the paper is fed manually. This determination is carried out in accordance with whether or not the manual paper feeding unit 9 is opened from the frame 2. When the manual paper feeding unit 9 is opened, the manual paper feeding unit sensor 44 is turned on. A switch signal from the manual paper feeding unit sensor 44 is loaded into the main control unit 11. Accordingly, a detection is made that the manual paper feeding unit 9 is opened. In case of the manual paper feeding, the process proceeds onto step ST22. Meanwhile, in case the paper is not fed manually, the process proceeds onto step ST29. At step ST29, a normal printing process is carried out.

At step ST22, a determination is made as to whether or not the printing process is for two sheets or more. When the original documents include two sheets or more, or when making a plurality of prints of the same original document, the process proceeds onto step ST23. Meanwhile, when a number of sheets to be printed is one sheet, the process proceeds onto step ST29. In this case, even when the paper is fed manually from the manual paper feeding unit 9, since the printing process is carried out for one sheet, a consideration is not necessary to be made as to whether the paper is fed manually. Therefore, the normal printing process is carried out.

At step ST23, a determination is made as to whether or not the paper size is unknown. In this case, the paper size of the paper fed by the manual paper feeding unit 9 is detected by the size sensors 42 and 43. The size sensor 42 detects the length of the paper. The size sensor 43 detects the width of the paper. If the paper size is a standard size, the paper size can be detected by the outputs from the size sensors 42 and 43. However, for example, if the width of the paper is not a standard width, there are cases in which the paper size cannot be detected (fixed). When the length of the paper is extremely long, a presumption can be made that the paper is jammed. When the paper size cannot be detected and the paper size is unknown, the process proceeds onto step ST24. Meanwhile, when the paper size is not unknown, the process proceeds onto step ST29. At step ST29, the normal printing process is carried out. In other words, the papers are fed at an interval according to the paper size.

At step ST24, a determination is made as to whether or not the printing process has been completed. At step ST24, a determination is made as to whether or not a printing process for a first sheet has been started and the printing process of the first sheet has been completed. When the printing process has not been completed, the process proceeds onto step ST27. Meanwhile, when the printing process of the first sheet has been completed, the process proceeds onto step ST25.

At step ST27, a determination is made as to whether the length of the printing paper (a counted number of values from a detection of a leading edge of the paper by the size sensor 42) is the length of the A3 size paper or shorter. The length of the A3 size paper corresponds to a period of time from the detection of the leading edge of the paper by the size sensor 42 until a detection of a trailing edge of the paper when the A3 size paper is fed. This period of time is stored in the size memory 15*a* as the length of the A3 size paper. Until the completion of the printing process, while the size detected by the size sensor 42 is smaller than the length of the A3 size paper, a determination is made that currently fed paper is smaller than the A3 size paper. Meanwhile, before the completion of the printing process, when the length of the paper detected by the size sensor 42 does not exceed the length of the A3 size paper, the process returns to step ST24 and the processes of steps ST24 and ST27 are repeated.

At step ST25, a determination is made as to the presence or the absence of a next page. In case of the presence of the next page to be printed, the process proceeds onto step ST26. At step ST26, since the printing process of the previous page has been already completed, the next page is fed. Then, the process returns to step ST22. Subsequently, the processes of steps ST22 through ST27 are executed on the fed paper. Meanwhile, in case of the absence of the next page to be printed, without feeding paper, the process ends.

At step ST27, when the printing process has not been completed yet and the length of the paper detected by the size sensor 42 is longer than the length of the A3 size paper, the process proceeds onto step ST28. At step ST28, a necessary processing is executed assuming that the paper is jammed. For example, a message such as "Paper is jammed" and "Please remove the jammed paper" is output from the voice output unit 18 or displayed on the display unit 19.

Figure 4:
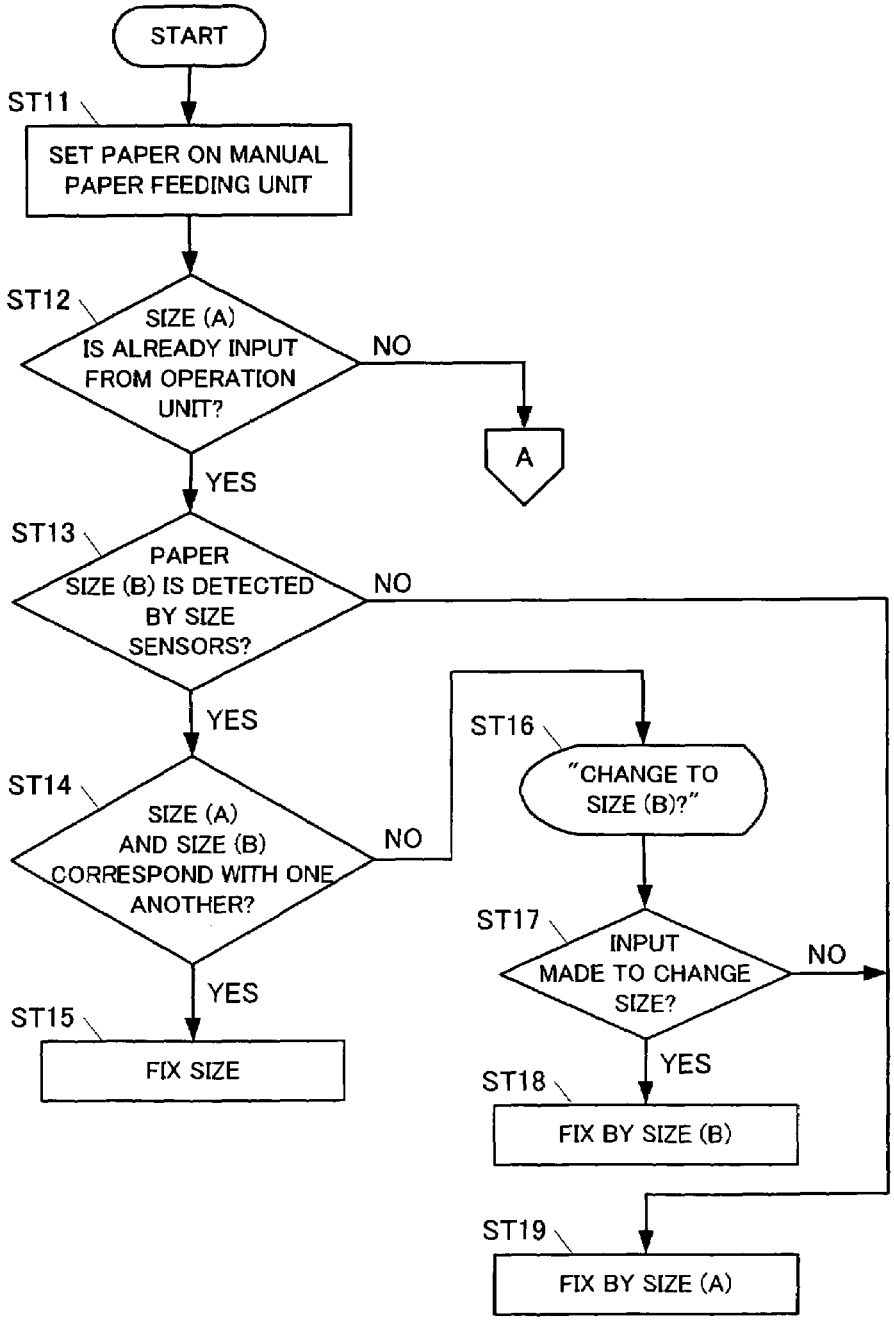
FIG. 4 is a flowchart of a processing operation carried out when feeding paper manually in the facsimile machine according to another embodiment of the present invention.

With reference to the flowchart of FIG. 4, another embodiment of the present invention will be described. When a job of this embodiment starts, at step ST11, paper is set on the manual paper feeding unit 9. Then, the process proceeds onto step ST12. At step ST12, a determination is made as to whether or not a size (A) (for example, one of A3, A4, B4 and B5) has already been input from the operation unit 20. When the size (A) has not been input from the operation unit 20, the process proceeds onto step ST2 of FIG. 3. Then, the processing is carried out in accordance with the flowchart of FIG. 3. Meanwhile, when the size (A) has already been input from the operation unit 20, the process proceeds onto step ST13.

At step ST13, a determination is made as to whether or not a paper size (B) of the paper fed from the manual paper feeding unit 9 has been detected by the size sensors. When the paper size (B) of the fed paper has been detected, the process proceeds onto step ST14. Meanwhile, when the paper size (B) of the fed paper has not been detected, the process proceeds onto step ST19. At step ST19, the size (A) already input from the operation unit 20 is fixed as the paper size.

At step ST14, a determination is made as to whether or not the size (A) and the size (B) correspond with one another. When the size (A) and the size (B) correspond with one another, the process proceeds onto step ST15. At step ST15, the corresponded size (A) (=(B)) is fixed as the paper size. Meanwhile, at step ST14, when the size (A) and the size (B)

do not correspond with one another, the process proceeds onto step ST16. At step ST16, a message "Change to size (B)?" is displayed on the display unit 19 to inquire from the user. In response to the displayed message, the user selects "YES" or "NO". Next, at step ST17, a determination is made as to whether or not an input has been made to change the size.

When the user selects "YES", in other words, when an input has been made to change the size, the process proceeds onto step ST18. Meanwhile, when the user selects "NO", in other words, when an input has been made to not change the size, the process proceeds onto step ST19. At step ST18, the size (B) is fixed as the paper size. At step ST19, the size (A) already input from the operation unit 20 is fixed as the paper size.

The invention claimed is:

1. A printing device with a manual paper feeding function, comprising:

a manual paper feeding unit;

a first paper size inputting means for inputting an input paper size of the manual paper feeding unit by an operation;

a second paper size inputting means for detecting a detected paper size of fed paper and inputting the detected paper size;

means for determining, when the input paper size is input by the first paper size inputting means, whether the detected paper size input by the second paper size inputting means corresponds with the input paper size;

means for inquiring on a display whether to fix the paper size to the detected paper size when the means for determining determines that the detected paper size does not correspond with the input paper size;

means for fixing the paper size when the means for determining determines that the detected paper size does not correspond with the input paper size, in accordance with a response to the inquiry on the display;

means for fixing the paper size when the means for determining determines that the detected paper size corresponds with the input paper size; and a sensing means, wherein, when the input paper size has not been input by the first paper size inputting means and the detected paper size is a nonstandard paper size, the sensing means senses whether the manual paper feeding unit has been opened and the printing device carries out a printing process on each fed paper so long as the detected paper size is within a predetermined range.

2. The printing device with the manual paper feeding function according to claim 1, wherein when the input paper size has been input by the first paper size inputting means, the paper size is fixed as the input paper size, and under a state in which the input paper size is not input by the first paper size inputting means, when the detected paper size input by the second paper size inputting means is a standard paper size, the detected paper size input by the second paper size inputting means is fixed as the paper size.

3. The printing device with the manual paper feeding function according to claim 1, wherein when receiving a response of "YES" to an inquiry on whether or not to fix the paper size to the detected paper size of the second size inputting means, the detected paper size is fixed, and when receiving a response of "NO", the input paper size is fixed.

4. The printing device with the manual paper feeding function according to claim 1, wherein the predetermined range is a length that does not exceed the length of A3 size paper.

5. The printing device with the manual paper feeding function according to claim 1, wherein, when the detected paper size is outside of the predetermined range, an operation is executed that assumes a paper jam.

6. A printing device with a manual paper feeding function, comprising:

a manual paper feeding unit;

a first paper size input unit that inputs an input paper size of the manual paper feeding unit by an operation;

a second paper size input unit that detects a detected paper size of fed paper and inputs the detected paper size;

a determining unit that determines, when the input paper size is input by the first paper size input unit, whether the detected paper size input by the second paper size input unit corresponds with the input paper size;

an inquiring unit that inquires on a display whether to fix the paper size to the detected paper size when the determining unit determines that the detected paper size does not correspond with the input paper size;

a paper size fixing unit that fixes the paper size when the determining unit determines that the detected paper size does not correspond with the input paper size, in accordance with a response to the inquiry on the display;

a paper size fixing unit that fixes the paper size when the determining unit determines that the detected paper size corresponds with the input paper size; and a sensor unit, wherein, when the input paper size has not been input by the first paper size input unit and the detected paper size is a nonstandard paper size, the sensor unit senses whether the manual paper feeding unit has been opened and the printing device carries out a printing process on each fed paper so long as the detected paper size is within a predetermined range.

7. The printing device with the manual paper feeding function according to claim 6, wherein when the input paper size has been input by the first paper size input unit, the paper size is fixed as the input paper size, and under a state in which the input paper size is not input by the first paper size input unit, when the detected paper size input by the second paper size input unit is a standard paper size, the detected paper size input by the second paper size input unit is fixed as the paper size.

8. The printing device with the manual paper feeding function according to claim 6, wherein when receiving a response of "YES" to an inquiry on whether or not to fix the paper size to the paper size of the second paper size input unit, the detected paper size is fixed, and when receiving a response of "NO", the input paper size is fixed.

9. The printing device with the manual paper feeding function according to claim 6, wherein the first paper size input unit is an operation unit.

10. The printing device with the manual paper feeding function according to claim 6, wherein the second paper size input unit is a pair of sensors.

11. The printing device with the manual paper feeding function according to claim 6, wherein the predetermined range is a length that does not exceed the length of A3size paper.

12. The printing device with the manual paper feeding function according to claim 6, wherein, when the detected paper size is outside of the predetermined range, an operation is executed that assumes a paper jam.

13. A method for manually feeding paper, comprising:

feeding paper;

providing an option to input an input paper size of the fed paper by an operation;

detecting a detected paper size of fed paper and inputting the detected paper size;

determining, when the input paper size is input by the operation, whether the detected paper size corresponds with the input paper size;

inquiring on a display whether to fix the paper size to the detected paper size when it is determined that the detected paper size does not correspond with the input paper size;

fixing the paper size when it is determined that the detected paper size does not correspond with the input paper size, in accordance with a response to the inquiry on the display;

fixing the paper size when it is determined that the detected paper size corresponds with the input paper size, and when the input paper size has not been input and the detected paper size is a nonstandard paper size, sensing whether the paper has been manually fed and carrying out a printing process on each fed paper so long as the detected paper size is within a predetermined range.

14. The method for manually feeding paper according to claim 13, further comprising:

fixing the paper size as the input paper size when the input paper size has been input by the operation; and fixing the paper size as the detected paper size, when the detected paper size is a standard size, under a state in which the input paper size is not input by the operation.

15. The method for manually feeding paper according to claim 13, further comprising:

fixing the paper size as the detected paper size when receiving a response of "YES" to an inquiry on whether or not to fix the paper size to the detected paper size of fed paper; and fixing the input paper size when receiving a response of "NO".

16. The method for manually feeding paper according to claim 13, wherein the predetermined range is a length that does not exceed the length of A3 size paper.

17. The method for manually feeding paper according to claim 13, and further comprising:

executing an operation that assumes a paper jam when the detected paper size is outside of the predetermined range.

* * * * *